US010081773B2

(12) United States Patent
Tort et al.

(10) Patent No.: US 10,081,773 B2
(45) Date of Patent: Sep. 25, 2018

(54) ADDITIVE COMPOSITIONS THAT IMPROVE THE STABILITY AND THE ENGINE PERFORMANCES OF DIESEL FUELS

(75) Inventors: Frédéric Tort, Brignais (FR); Christian Vermorel, Lyons (FR)

(73) Assignee: Total Marketing Services, Puteaux (FR)

( * ) Notice: Subject to any disclaimer, the term of this patent is extended or adjusted under 35 U.S.C. 154(b) by 16 days.

(21) Appl. No.: 14/131,835

(22) PCT Filed: Jul. 11, 2012

(86) PCT No.: PCT/EP2012/063532

§ 371 (c)(1),
(2), (4) Date: Jan. 9, 2014

(87) PCT Pub. No.: WO2013/007738

PCT Pub. Date: Jan. 17, 2013

(65) Prior Publication Data

US 2014/0157655 A1 Jun. 12, 2014

(30) Foreign Application Priority Data

Jul. 12, 2011 (FR) ..... 11 56363

(51) Int. Cl.
*C10L 1/183* (2006.01)
*C10L 1/16* (2006.01)
(Continued)

(52) U.S. Cl.
CPC ..... *C10L 1/16* (2013.01); *C10L 1/143* (2013.01); *C10L 1/183* (2013.01); *C10L 1/19* (2013.01);
(Continued)

(58) Field of Classification Search
CPC .... C10L 1/1832; C10L 1/2283; C10L 1/2383; C10L 1/143; C10L 1/16; C10L 1/1608;
(Continued)

(56) References Cited

U.S. PATENT DOCUMENTS 3,219,666 A 11/1965 Norman et al.
3,329,658 A 7/1967 Fields
(Continued)

FOREIGN PATENT DOCUMENTS

CA 2051452 C 3/1992
CN 102051239 A 5/2011
(Continued)

OTHER PUBLICATIONS

Database WPI, Section Ch, 2011, Thomson Scientific, London, GB; Class A10, AN 2011-G86843, XP002670393, Li H et al.: "Additive composition used in diesel composition,".
(Continued)

*Primary Examiner* — Latosha Hines
(74) *Attorney, Agent, or Firm* — Harness, Dickey & Pierce, P.L.C.

(57) ABSTRACT

An additive composition improves the stability and the engine performances of gas oils, including gas oils of the non-road type in compliance with the decree of 10 Dec. 2010, including:

(a) at least one metal deactivator or chelating agent,
(b) at least one antioxidant of the hindered phenol type (alkylphenol),
(c) at least one dispersant and/or detergent,
(d) at least one metal passivator,
where the compositions include improved properties, in particular relative to the oxidation resistance, storage stability, thermal stability, reduction in fouling of the
(Continued)

injectors, reduction in loss of power, reduction in the tendency of the filters to clog.

12 Claims, 1 Drawing Sheet

(51) Int. Cl.

| | |
|---|---|
| ***C10L 1/14*** | (2006.01) |
| ***C10L 1/19*** | (2006.01) |
| ***C10L 1/228*** | (2006.01) |
| ***C10L 1/232*** | (2006.01) |
| ***C10L 10/00*** | (2006.01) |
| ***C10L 10/04*** | (2006.01) |
| ***C10L 10/14*** | (2006.01) |
| *C10L 1/185* | (2006.01) |
| *C10L 1/195* | (2006.01) |
| *C10L 1/197* | (2006.01) |
| *C10L 1/222* | (2006.01) |
| *C10L 1/236* | (2006.01) |
| *C10L 1/238* | (2006.01) |
| *C10L 1/2383* | (2006.01) |
| *C10L 1/2387* | (2006.01) |

(52) U.S. Cl.
CPC ..... *C10L 1/2283* (2013.01); *C10L 1/232* (2013.01); *C10L 10/00* (2013.01); *C10L 10/04* (2013.01); *C10L 10/14* (2013.01); *C10L 1/1608* (2013.01); *C10L 1/1616* (2013.01); *C10L 1/1832* (2013.01); *C10L 1/1835* (2013.01); *C10L 1/1855* (2013.01); *C10L 1/195* (2013.01); *C10L 1/1973* (2013.01); *C10L 1/2222* (2013.01); *C10L 1/236* (2013.01); *C10L 1/238* (2013.01); *C10L 1/2383* (2013.01); *C10L 1/2387* (2013.01)

(58) Field of Classification Search
CPC ..... C10L 1/1616; C10L 1/183; C10L 1/1835; C10L 1/1855; C10L 1/19; C10L 1/195; C10L 1/1973; C10L 1/2222; C10L 1/232; C10L 1/236; C10L 1/238; C10L 1/2387; C10L 10/00; C10L 10/04; C10L 10/14
USPC ..... 44/343
See application file for complete search history.

(56) References Cited

U.S. PATENT DOCUMENTS

| | | | | |
|---|---|---|---|---|
| 3,565,804 | A | 2/1971 | Honnen et al. | |
| 3,702,300 | A | 11/1972 | Coleman | |
| 4,511,369 | A | 4/1985 | Denis et al. | |
| 4,652,273 | A | 3/1987 | Maldonado et al. | |
| 4,664,676 | A | 5/1987 | Denis et al. | |
| 4,731,095 | A | 3/1988 | Garapon et al. | |
| 4,900,332 | A | 2/1990 | Denis et al. | |
| 5,106,515 | A | 4/1992 | Denis et al. | |
| 5,256,740 | A | 10/1993 | Denis et al. | |
| 5,449,386 | A | 9/1995 | Denis et al. | |
| 5,454,843 | A * | 10/1995 | Rollin | C10L 1/143 44/447 |
| 5,456,730 | A | 10/1995 | Hart et al. | |
| 5,492,544 | A * | 2/1996 | Farng | C10L 1/221 44/331 |
| 5,697,988 | A | 12/1997 | Malfer et al. | |
| 5,782,937 | A * | 7/1998 | Colucci | C10L 1/143 44/324 |
| 5,998,530 | A | 12/1999 | Krull et al. | |
| 6,071,318 | A | 6/2000 | Mallet et al. | |
| 7,741,241 | B2 | 6/2010 | Cholley et al. | |
| 7,744,660 | B2 | 6/2010 | Burrington et al. | |
| 8,318,628 | B2 | 11/2012 | Brun et al. | |
| 8,535,515 | B2 | 9/2013 | Cholley et al. | |
| 9,034,060 | B2 | 5/2015 | MacMillan | |
| 9,243,199 | B2 | 1/2016 | Reid | |
| 2003/0150153 | A1 | 8/2003 | Henry et al. | |
| 2003/0196372 | A1 * | 10/2003 | Wolf | C10L 1/143 44/389 |
| 2005/0223627 | A1 | 10/2005 | Eydoux et al. | |
| 2005/0223631 | A1 | 10/2005 | Jackson | |
| 2006/0128574 | A1 * | 6/2006 | Dong | C10L 1/143 508/557 |
| 2006/0272597 | A1 * | 12/2006 | Burrington | C10L 1/14 123/1 A |
| 2006/0276352 | A1 * | 12/2006 | Vinci | C10M 163/00 508/272 |
| 2008/0127550 | A1 | 6/2008 | Li et al. | |
| 2009/0300974 | A1 * | 12/2009 | Burgazli | C10L 1/14 44/308 |
| 2010/0048438 | A1 * | 2/2010 | Carey | C10M 141/10 508/436 |
| 2010/0210492 | A1 | 8/2010 | Lange et al. | |
| 2011/0039741 | A1 * | 2/2011 | Thoen | C10M 141/06 508/476 |
| 2013/0255139 | A1 | 10/2013 | Dolmazon et al. | |
| 2013/0305596 | A1 | 11/2013 | Amblard et al. | |

FOREIGN PATENT DOCUMENTS

| | | | |
|---|---|---|---|
| CN | 102051240 | A | 5/2011 |
| EP | 0261959 | A2 | 3/1988 |
| EP | 0271385 | A1 | 6/1988 |
| EP | 1591514 | A2 | 11/2005 |
| FR | 2528423 | A1 | 12/1983 |
| GB | 2121808 | A | 1/1984 |
| JP | 2002309273 | A | 10/2002 |
| WO | WO-9314178 | A1 | 7/1993 |
| WO | WO-9413758 | A1 | 6/1994 |

OTHER PUBLICATIONS

Database WPI, Section Ch, 2011, Thomson Scientific, London, GB; Class A10, AN 2011-G58797, XP002670392, Huang Y et al.: "Additive composition used for diesel composition.".

* cited by examiner

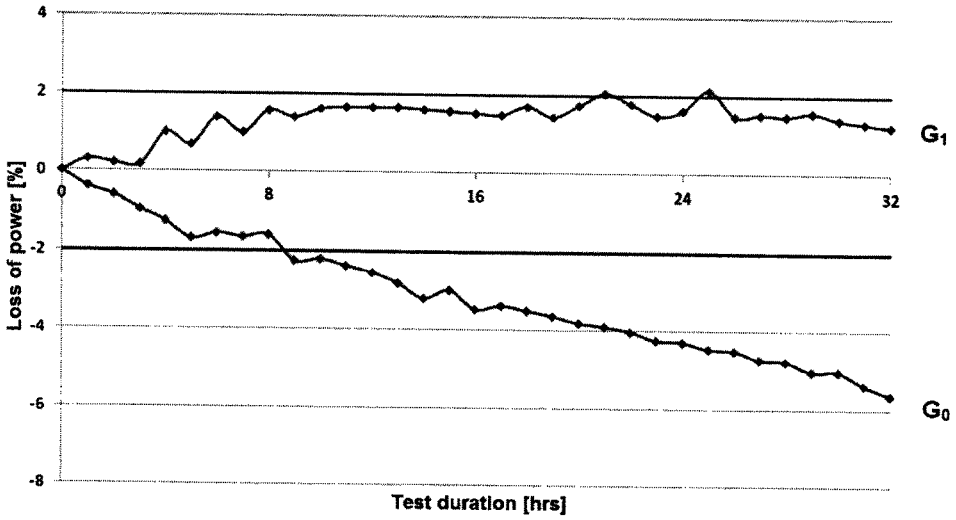
4
2
0
-2
-4
-6
-8
Loss of power [%]
0
8
16
24
32
Test duration [hrs]
G1
G0

ADDITIVE COMPOSITIONS THAT IMPROVE THE STABILITY AND THE ENGINE PERFORMANCES OF DIESEL FUELS

CROSS-REFERENCE TO RELATED APPLICATIONS

This application is a National Phase Entry of International Application No. PCT/EP2012/063532, filed on Jul. 11, 2012, which claims priority to French Patent Application Serial No. 1156363, filed on Jul. 12, 2011, both of which are incorporated by reference herein.

BACKGROUND AND SUMMARY

The present invention relates to additive compositions making it possible to improve the stability and engine performances of the gas oils used as diesel fuel, in particular gas oils of the non-road type.

Since the entry into force of the decree of 10 Dec. 2010, in France the term "gazole non routier" [non-road gas oil] denotes a mixture of hydrocarbons of mineral origin or from synthesis with 7 parts by volume of fatty acid methyl esters according to the minimum requirements of the standard EN 590 or any other standard or specification in force in the EU having a maximum sulphur content of 20 mg/kg at the distribution stage. Previously, domestic fuel oil (dfo) was intended both for heating applications and engine applications; since this Decree, the products are differentiated, i.e. distributed in different distribution networks and required to be stored in separate storage facilities in different networks according to their intended use: stationary applications (heating) on the one hand, and non-stationary applications (non-road gas oil). For heating applications, the fuel oil has a sulphur content of 1,000 pm mass whereas the non-road gas oil has a sulphur content less than or equal to 10 ppm by mass (tolerance 20 ppm); the cetane number of domestic fuel oil is 40 whereas that of non-road gas oil is 51 (better flammability).

In France the use of non-road gas oil, marketed via a specific distribution network and subject to a diferent tax regime to that of motor vehicles is mandatory for

- non-road mobile machinery, such as
  - construction and civil engineering equipment, in particular bulldozers, all-terrain trucks, excavators, tractors and loaders,
  - road maintenance equipment
  - snow ploughs and street sweepers,
  - self-propelled agricultural vehicles, forestry equipment,
  - handling equipment, mobile cranes, power lift trucks,
  - self-propelled ladders and platforms,
  - ground airport assistance equipment
  - industrial drilling equipment,
  - compressors and motor-driven pumps,
  - railway locomotives,
  - truck-mounted generators or hydraulic power units,
- agricultural or forestry tractors,
- pleasure boats,
- inland navigation boats.

For environmental reasons and/or because of the availability of resources, regulations in many countries encourage the introduction of constantly increasing quantities of products of renewable origin, such as fatty acid esters, into conventional gas oil and non-road gas oil. Thus, at present in the EU, the on-road gas oil used as diesel fuel can contain 7 parts by volume of fatty acid esters, generally fatty acid methyl esters (FAME), essentially or exclusively of vegetable or animal origin (vegetable and/or animal oil esters, in particular vegetable oil methyl esters or VOMEs).

In the past, the machinery engines operating with non-road gas oil were deemed to be unsophisticated and undemanding but the specifications of these engines have developed and are increasingly operating according to technologies as advanced (very high pressure direct injection technologies) as those of on-road motor vehicles. Standard-grade non-road gas oil (currently in compliance with the standard EN 590) sometimes poses problems in terms of:

- stability during storage and use: in the case of prolonged storage or in the case of use under conditions of high pressures or temperatures: the antioxidants incorporated in the FAME are not always sufficient to stabilize the product and do not make it possible to combat the action of metals (catalysts of oxidation and degradation phenomena). This instability of the fuel can lead to phenomena of fouling of the filters and injection systems.
- extraction of metals: the FAMEs and their by-products have a tendency to promote the extraction of metals with which they are brought into contact, for example transport, storage materials and/or parts or components.
- low-temperature performance: in particular for non-road gas oils, given the prolonged period of storage of such fuels which is sometimes greater than 6 months, and taking account of the seasonal nature of the specifications in the winter period or between seasons, the low-temperature performance can be problematic for the user (problems of crystallization, sedimentation, filter plugging etc.).

There is therefore a need to improve the quality of the gas oils and, in particular, to provide novel additive compositions capable of improving the properties of the gas oils irrespective of their intended use or their composition (with or without products of renewable origin): on-road gas oil or non-road gas oil, of types B0 to B7.

The present invention proposes a high-grade on-road or non-road gas oil which has improved properties compared with the corresponding standard-grade on-road or non-road gas oil (EN 590). Within the meaning of the present invention, several of the properties of the standard gas oil are improved, and in particular the oxidation resistance, storage stability, thermal stability and engine performances (reduction in fouling of the injectors; the following improvements are also possible: reduction in the loss of power; reduction in the tendency of the filters to clog etc.); low-temperature performance (CFPP and pour point). The invention also relates to additive compositions capable of improving the properties of the gas oil, in particular of the non-road gas oil, such as oxidation resistance, storage stability, thermal stability, engine performances (reduction in fouling of the injectors); low-temperature performance (CFPP and pour point), reduction in loss of power, reduction the tendency of the filters to clog etc.) can also be improved. This additive composition added to the fuel (on-road or non-road gas oil) more particularly makes it possible to reduce the tendency of the injectors to be fouled by the fuel. The fouling of the injectors can lead to losses of power but also a degradation of combustion which is responsible for an increase in pollutant emissions.

BRIEF DESCRIPTION OF THE DRAWING

Other advantages and characteristics will become more clearly apparent from the following description of particular embodiments of the invention given as non-limitative examples and represented in the single attached drawing in which FIG. 1 represents the loss of power (in %) as a function of the duration (in hours) of an injector fouling test according to the CEC DW10 procedure referenced SG-F-098, on a diesel fuel composition, reference gas oil G0 and a diesel gas oil fuel composition $G_1$ according to the present invention.

DETAILED DESCRIPTION

A first subject of the invention relates to additive compositions comprising the following components:

a) at least one metal deactivator or chelating agent,
b) at least one antioxidant of the hindered phenol type (alkylphenol),
c) at least one dispersant, and optionally d) at least one acidity neutralizer (acid scavenger) of aliphatic, cycloaliphatic or aromatic amine type,
e) at least one low-temperature performance additive,
f) at least one tracer or marker,
g) at least one fragrancing agent and/or agent for masking odours and/or reodorant,
h) at least one biocide,
i) at least one metal passivator.

According to a particularly preferred embodiment, the additive compositions comprise the following components:

a) at least one metal deactivator or chelating agent,
b) at least one antioxidant of the hindered phenol type (alkylphenol),
c) at least one dispersant,
i) at least one metal passivator, and optionally d) at least one acidity neutralizer (acid scavenger) of the aliphatic, cycloaliphatic or aromatic amine type,
e) at least one low-temperature performance additive,
f) at least one tracer or marker,
g) at least one fragrancing agent and/or agent for masking odours and/or reodorant,
h) at least one biocide.

According to a particular embodiment, the metal passivator i) is chosen from the triazole derivatives, alone or in a mixture, for example benzotriazole derivatives. By "triazole derivatives" is meant all of the compounds comprising a triazole unit, i.e. a 5-membered aromatic cyclic unit, comprising two double bonds and 3 nitrogen atoms. According to the position of the nitrogen atoms, a distinction is drawn between the 1,2,3-triazole units (called V-triazoles) and the 1,2,4-triazole units (called S-triazoles). As examples of triazole units, benzotriazole or tolyltriazole can be mentioned.

The metal passivator i) can be chosen from the amines substituted by triazole groups, alone or in a mixture. By "triazole group" is meant any substituent containing a triazole unit as defined above. The metal passivator(s) i) can, for example, be chosen from N,N-Bis(2-ethylhexyl)-1,2,4-triazol-1-ylmethanamine (CAS 91273-04-0) and N,N'-bis-(2-ethylhexyl)-4-methyl-1H-benzotriazole amine (CAS 80584-90-3), alone or in a mixture and the passivators described on page 5 of US2006/0272597 cited by way of example and the content of which is incorporated by way of reference. In particular, the metal passivator is advantageously chosen from N,N-bis(2-ethylhexyl)-1,2,4-triazol-1-ylmethanamine (CAS 91273-04-0) and N,N'-bis-(2-ethylhexyl)-4-methyl-1H-benzotriazole amine (CAS 80584-90-3), alone or in a mixture.

According to the nature and the miscibility of constituents a) to i) of the additive composition according to the invention, with gas oil, the additive composition can also contain one or more hydrocarbon organic solvents and optionally at least one compatibilizing agent or co-solvent. Preferably, the additive composition also comprises at least one hydrocarbon organic solvent and/or at least one compatibilizing agent or co-solvent. The metal deactivator(s) or chelating agents a) can be chosen from amines substituted by N,N'-disalicylidene groups, such as N,N'-disalicylidene 1,2-diaminopropane (DMD).

The antioxidant or antioxidants b) can be chosen from molecules comprising at least one hindered phenol group (alkylphenols), alone or in a mixture; as examples of antioxidants of the hindered phenol type, there can be mentioned di-t-butyl-2,6 methyl-4 phenol (BHT), t-butyl hydroquinone (TBHQ), 2,6 and 2,4 di-t-butyl phenol, 2,4-dimethyl-6-t-butyl phenol, pyrogallol, tocopherol, 4,4'-methylene bis(2,6-di-t-butyl phenol) (CAS No. 118-82-1), alone or in a mixture.

The dispersant(s) c) can for example be chosen from:

substituted amines such as N-polyisobutene amine R1-$NH_2$, N-polyisobutenethylenediamine R1-NH—R2-$NH_2$, or also the polysiobutenesuccinimides of formula

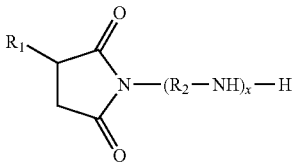

where $R_1$ represents a polyisobutene group with a molecular mass comprised between 140 and 5000 and preferably between 500 and 2000 or, preferably, between 750 and 1250;

$R_2$ represents at least one of the following segments —$CH_2$—$CH_2$—, $CH_2$—$CH_2$—$CH_2$, —CH—CH($CH_3$)— and x an integer comprised between 1 and 6.

The polyethylene amines are particularly effective. They are for example described in detail in the reference "Ethylene Amines" Encyclopedia of Chemical Technology, Kirk and Othmer, Vol. 5, pp. 898-905, Interscience Publishers, New York (1950).

the polyetheramines of formula:

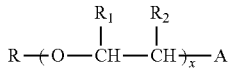

where:

R is an alkyl group comprising from 1 to 30 carbon atoms;

R1 and R2 are each independently a hydrogen atom, an alkyl chain of from 1 to 6 carbon atoms or —O—CHR1-CHR2-;

A is an amine or N-alkylamine with 1 to 20 carbon atoms in the alkyl chain, an N,N-dialkylamine having from 1 to 20 carbon atoms in each alkyl group, or a polyamine with 2 to 12 nitrogen atoms and 2 to 40 carbon atoms.

and x ranging from 5 to 100;

Such polyetheramines are for example marketed by BASF, HUNTSMAN or CHEVRON.

the products of reaction between a phenol substituted by a hydrocarbon chain, an aldehyde and an amine or polyamine or ammonia.

The alkyl group of the alkylated phenol can be constituted by 10 to 110 carbon atoms. This alkyl group can be obtained by polymerization of olefinic monomer containing from 1 to 10 carbon atoms (ethylene; propylene; 1-butene, isobutylene and 1 decene). The polyolefins particularly used are polyisobutene and/or polypropylene. The polyolefins generally have a weight average molecular weight Mw comprised between 140 and 5000 and preferably between 500 and 2000 or preferably between 750 and 1250.

The alkylphenols can be prepared by alkylation reaction between a phenol and an olefin or a polyolefin such as polyisobutylene or polypropylene.

The aldehyde used can contain from 1 to 10 carbon atoms, generally formaldehyde or paraformaldehyde.

The amine used can be an amine or a polyamine including the alkanolamines having one or more hydroxy groups. The amines used are generally chosen from ethanolamine, the diethanolamines, methylamine, dimethylamine, ethylenediamine, dimethylaminopropylamine, diethylenetriamine and/or 2-(2-aminoethylamino)ethanol. This dispersant can be prepared by a Mannich reaction by reacting an alkylphenol, an aldehyde and an amine as described in the U.S. Pat. No. 5,697,988.

other dispersants, such as:

carboxylic dispersants such as those described in U.S. Pat. No. 3,219,666;

aminated dispersants originating from the reaction between halogenated aliphatics of high molecular weight with amines or polyamines preferably polyalkylene polyamines, described for example in U.S. Pat. No. 3,565,804;

polymeric dispersants obtained by polymerization of alkylacrylates alkylmethacrylates (C8 to C30 alkyl chains), aminoalkylacrylates or acrylamides and acrylates substituted by poly-(oxyethylene) groups. Examples of polymeric dispersants are for example described in U.S. Pat. Nos. 3,329,658 and 3,702,300.

The optional acid neutralizer(s) or scavenger(s) d) can be chosen, from the aliphatic, cycloaliphatic and aromatic amines. Preferably, it is preferred to use dimethylcyclohexyldiamine as acidity neutralizer. The low-temperature performance additive or additives e) can be chosen from additives improving the pour point, additives improving the cold filter plugging point (CFPP), additives improving the cloud point and/or the anti-sedimentation additives and/or paraffin dispersants. As examples of additives improving the pour-point and filtrability (CFIs), there can be mentioned the ethylene and vinyl acetate (EVA) copolymers and/or ethylene and vinyl propionate (EVP) copolymers.

As examples of additives improving the CFPP, there can be mentioned the multi-functional cold operability additives chosen from particular from the group constituted by the polymers based on olefin and alkenyl nitrate such as those described in EP 573 490. As examples of additives improving the cloud point, there can be mentioned non-limitatively the compounds chosen from the group constituted by the long-chain olefin/(meth)acrylic ester/maleimide terpolymers, and fumaric/maleic acid ester polymers. Examples of such additives are given in EP 71 513, EP 100 248, FR 2 528 051, FR 2 528 423, EP1 12 195, EP 1 727 58, EP 271 385 and EP 291367. As examples of anti-sedimentation additives and/or paraffin dispersants, it is possible to use in particular anti-sedimentation (but non-limitatively) additives chosen from the group constituted by the (meth)acrylic acid/polyamine-amidified alkyl (meth)acrylate copolymers, polyamine alkenylsuccinimides, phthalamic acid and double-chain fatty amine derivatives; alkylphenol/aldehyde resins. Examples of such additives are given in EP 261 959, EP593 331, EP 674 689, EP 327 423, EP 512 889, EP 832 172; US 2005/0223631; U.S. Pat. No. 5,998,530; WO 93/14178.

Preferably, the additive compositions according to the invention contain ethylene/vinyl acetate (EVA) copolymers and/or ethylene/vinyl acetate/vinyl versatate (VEOVA) terpolymers and/or ethylene/vinyl acetate/acrylic ester (2-ethylhexyl acrylate) terpolymers as low-temperature additive e).

The optional marker(s) or tracer(s) f) can in particular be chosen from the following aliphatic or cycloaliphatic esters:

3a,4,5,6,7,7a-hexahydro-4,7-methano-1h-inden-5 (or 6)-yl isobutyrate (CAS 67634-20-2)

tricyclodecenyl propionate (CAS 17511-60-3)

cis 3 hexenyl acetate (CAS 3681-71-8)

ethyl linalool (CAS 10339-55-6)

prenyl acetate (CAS 1191-16-8)

ethyl myristate (CAS 124-06-1)

para-tert-butyl cyclohexyl acetate (CAS 32210-23-4)

butyl acetate (CAS 123-86-4), 4,7-methano-1h-inden-6-ol, 3a,4,5,6,7,7a-hexahydro-, acetate (CAS 5413-60-5)

ethyl caprate (CAS 110-38-3).

The optional fragrancing agent(s) or agent(s) for masking odours and/or reodorant(s) g) can be chosen from:

the organic tricyclic compounds described in EP 1,591, 514 which are organic tricyclic compounds of formula (I) below (I)

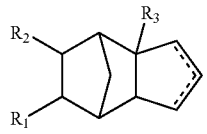

in which the cyclopentane ring is saturated or unsaturated, and R1, R2, R3, identical or different, are chosen from hydrogen and the hydrocarbon radicals comprising from 1 to 10 carbon atoms and optionally comprising one or more heteroatoms as well as the aliphatic or aromatic aldehydes such as vanillin, the aliphatic or aromatic esters, such as benzyl acetate, the alcohols, such as linalool, the phenylethyl alcohols, the ketones, such as crystallized camphor, ethyl maltol, the essential oils, such as essential oil derived from citrus fruits alone or in a mixture.

Advantageously, it is preferable to use as fragrancing agent, agent for masking odours or reodorant g), a mixture of at least one organic tricyclic compound and at least one aldehyde, ester, hydroxide, ketone, essential oil as defined above.

The biocide(s) h) can be chosen from:

the oxazolidines: 3,3'-methylenebis[5-methyloxazolidine] (CAS No. 66204-44-2);

mixtures (CAS No. 55965849) of the following compounds: 5-chloro-2-methyl-2H-isothiazol-3-one (CAS: 26172-55-4 and EINECS 247-500-7) and 2-methyl-2H-isothiazol-3-one (CAS No. 2682-20-4 and EINECS 220-239-6);

mixtures of isothiocyanates: methylene bis(thiocyanate) (CAS: 6317-18-6) and 2-(thiocyano methylthio)benzothiazole (CAS: 21564-17-0);

quaternary ammonium salts in the form of chlorides obtained from C12-C18 alkyl benzene or alkyl dimethyl benzene.

Certain components of the compositions according to the invention can have several functionalities, typically marker and fragrancing agent: a component can be both marker and fragrancing agent.

Preferably, the additive composition according to the invention comprises:

a) at least one metal sequestering agents chosen from the amines substituted by N,N'-disalicylidene groups, such as N,N'-disalicylidene 1,2-diaminopropane (DMD), b) at least one antioxidant of the hindered phenol type, chosen from the molecules comprising at least one hindered phenol group, alone or in a mixture; as examples of antioxidants of the hindered phenol type, there can be mentioned di-t-butyl-2,6 methyl-4 phenol (BHT), t-butyl hydroquinone (TBHQ), 2,6 or 2,4 di-t-butyl phenol, 2,4-dimethyl-6-t-butyl phenol, pyrogallol, tocopherol, 4,4'-methylene bis(2,6-di-t-butyl phenol) (CAS No. 118-82-1), alone or in a mixture, c) at least one dispersant and/or detergent, preferably chosen from the PIBSIs, d) at least one acidity neutralizer of the amine type, and optionally e) at least one additive for improving low-temperature performance chosen from the EVA copolymers and/or VEOVA terpolymers, f) at least one marker or tracer, g) at least one fragrancing agent and/or agent for masking odours and/or reodorant, chosen from:

the organic tricyclic compounds described in EP 1,591, 514 which are organic tricyclic compounds of formula (I) below (I)

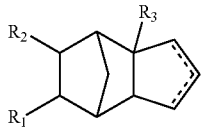

in which the cyclopentane ring is saturated or unsaturated, and R1, R2, R3, identical or different, are chosen from hydrogen and the hydrocarbon radicals comprising from 1 to 10 carbon atoms and optionally comprising one or more heteroatoms as well as the aliphatic or aromatic aldehydes such as vanillin, the aliphatic or aromatic esters, such as benzyl acetate, the alcohols, such as linalool, the phenylethyl alcohols, the ketones, such as crystallized camphor, ethyl maltol, the essential oils, such as essential oil derived from citrus fruits mixtures thereof, and preferably, the mixture of at least one organic tricyclic compound and at least one aldehyde, ester, hydroxide, ketone, essential oil, and/or h) at least one biocide additive, i) at least one metal passivator i) chosen from the amines substituted by triazole groups, such as benzotriazole, toluoyltriazole.

According to a particularly preferred embodiment, the additive composition according to the invention comprises:

a) at least one metal-sequestering agent chosen from the amines substituted by N,N'-disalicylidene groups, such as N,N'-disalicylidene 1,2-diaminopropane (DMD), b) at least one antioxidant of the hindered phenol type, chosen from the molecules comprising at least one hindered phenol group, alone or in a mixture; as examples of antioxidants of the hindered phenol type, there can be mentioned di-t-butyl-2,6 methyl-4 phenol (BHT), t-butyl hydroquinone (TBHQ), 2,6 or 2,4 di-t-butyl phenol, 2,4-dimethyl-6-t-butyl phenol, pyrogallol, tocopherol, 4,4'-methylene bis(2,6-di-t-butyl benol) (CAS No. 118-82-1), alone or in a mixture, and from the molecules generally, c) at least one dispersant and/or detergent, chosen preferably from the PIBSIs, d) at least one acidity neutralizer of the amine type, i) at least one metal passivator i) chosen from the amines substituted by triazole groups, such as benzotriazole, toluoyltriazole, and optionally e) at least one additive for improving low-temperature performance chosen from the EVA copolymers and/or VEOVA terpolymers, f) at least one marker or tracer, h) at least one biocide additive, and/or g) at least one fragrancing agent and/or agent for masking odours and/or reodorant, chosen from:

the organic tricyclic compounds described in EP 1,591, 514 which are organic tricyclic compounds of formula (I) below (I)

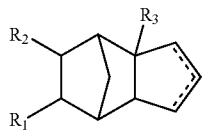

in which the cyclopentane ring is saturated or unsaturated, and R1, R2, R3, identical or different, are chosen from hydrogen and the hydrocarbon radicals comprising from 1 to 10 carbon atoms and optionally comprising one or more heteroatoms as well as the aliphatic or aromatic aldehydes such as vanillin, the aliphatic or aromatic esters, such as benzyl acetate, the alcohols, such as linalool, the phenylethyl alcohols, the ketones, such as crystallized camphor, ethyl maltol, the essential oils, such as essential oil derived from citrus fruits mixtures thereof, and preferably, the mixture of at least one organic tricyclic compound and at least one aldehyde, ester, hydroxide, ketone, essential oil.

Apart from the components described previously, the additive composition according to the invention can contain, apart from the additive(s) according to the invention, one or more other additives, different from the constituents a) to i), and solvent(s) and/or co-solvents such as for example markers other than those corresponding to the definition of the markers e) and in particular the markers mandated by regulations, for example the Red dye at present required by the regulations in non-road gas oil and domestic fuel oil, demulsifiers; the anti-static or conductivity improving additives; lubricity additives, anti-wear agents and/or friction modifiers, additives for improving combustion and in particular cetane improving additives, anti-foaming additives etc.

Preferably, the additive compositions according to the invention comprise:

- from 0.1 to 5% by mass and preferably from 1 to 2% by mass of metal sequestering agent(s) a),
- from 1 to 30% by mass and preferably from 2.5 to 10% by mass of antioxidant(s) of the hindered phenol type (alkylphenol) b),
- from 0.5 to 20% by mass and preferably from 1 to 10% by mass of dispersant(s) and/or detergent(s) c),
- from 0 to 20% by mass, preferably from 0.5 to 20% by mass and advantageously from 1 to 10% by mass of acidity neutralizers d),
- from 0 to 30% by mass and preferably from 10 to 20% by mass of low-temperature performance additive(s) e),
- from 0 to 5% by mass and preferably from 0.2 to 5% by mass of tracer(s) f),
- from 0 to 10% by mass and preferably from 2 to 5% by mass of fragrancing agent(s) and/or agent(s) for masking odours and/or reodorant(s) g),
- from 0 to 20% by mass and preferably from 5 to 10% by mass and advantageously from 1 to 2% by mass of biocide(s) h),
- from 0 to 5% by mass or up to 5% by mass, preferably from 0.1 to 5%, more preferentially from 0.5 to 3.5%, even more preferentially from 1 to 2% by mass of metal passivator(s) i),
- from 10 to 80% by mass and preferably from 20 to 50% by mass of hydrocarbon organic solvent(s),
- from 10 to 60% by mass and preferably from 20 to 40% by mass of compatibilizing agent(s) or co-solvent(s).

According to a second subject, the invention relates to a method for the preparation of the additive compositions as defined above, by mixing, preferably at ambient temperature, components a) to c), and optionally e) to i) of said compositions and/or solvent(s) and/or compatibilizing agent(s), in one or more steps by any suitable mixing means. According to a particular embodiment, the method for the preparation of the additive compositions as defined above, is carried out by mixing, preferably at ambient temperature, components a) to c) and compound i), and optionally e) to h) of said compositions and/or solvent(s) and/or compatibilizing agent(s), in one or more steps by any suitable mixing means. When the additive compositions according to the invention also comprise solvent(s) and/or co-solvent, they can be prepared in the same way, by mixing the components in one or more steps. The additive compositions according to the invention have the additional advantage of being stable in storage for at least several months at temperatures generally ranging from −15° C. to +40° C. and can therefore be stored, for example in a depot, at the refinery, before being mixed with standard gas oil or non-road gas oil.

According to a third subject the invention relates to a liquid fuel composition of the gas oil type comprising:

- a majority part of a mixture based on liquid hydrocarbons having distillation temperatures comprised between 150 and 380° C., preferably between 160 and 370° C., more preferentially between 180 and 370° C. These mixtures generally originate from middle distillate-type cuts, originating from refineries and/or from agrofuels and/or from biofuels and/or from biomass and/or from synthetic fuels, and in particular from kerosene cuts generally rich in aromatic compounds (benzene, etc.)
- a minority part comprising at least one additive composition as defined above, and optionally one or more additives other than those of the additive composition (s) according to the invention, which may or may not be in the form of a package of additives.

By "fuel" is meant a fuel which powers an internal combustion engine. In particular, a liquid fuel of the gas oil type is considered to be a fuel which powers a diesel type engine. By "majority part" is meant the fact that the liquid fuel composition of the gas oil type comprises at least 50% by mass of the mixture based on liquid hydrocarbons.

The mixture based on liquid hydrocarbons is, advantageously, constituted by any mixture of hydrocarbons capable of being used as diesel fuel. Diesel fuels generally comprise hydrocarbon cuts having a distillation range (determined according to the standard ASTM D 86) comprised between 150 and 380° C., with an initial boiling point comprised between 150 and 180° C. and a final boiling point comprised between 340 and 380° C. The density at 15° C. of the gas oils is in a standard fashion comprised between 0.810 and 0.860.

According to a particular embodiment, the liquid fuel composition of the gas oil type can comprise a product of renewable origin such as fatty acid esters. The renewable product content in the liquid fuel composition of the gas oil type is, advantageously, at least 0.2% by mass. The liquid fuel composition of the gas oil type can comprise at least seven parts by volume of at least one product of renewable origin. The product of renewable origin is chosen from the fatty acid esters, essentially or exclusively of animal or vegetable origin. The fatty acid esters are advantageously fatty acid methyl esters (FAMEs), essentially or exclusively of vegetable or animal origin, for example vegetable and/or animal oil esters, in particular vegetable oil methyl esters or VOMEs.

Preferably, the liquid fuel composition of the on-road or non-road gas oil type according to the invention comprises from 100 to 2000 ppm, preferably from 250 to 1500 ppm, more preferentially from 250 to 1000 ppm by mass of additive composition(s) as defined above. The other optional additives are generally incorporated in quantities ranging from 50 to 1500 ppm by mass. As examples of other optional additives, there can be mentioned, non-limitatively, lubricity or anti-wear additives, combustion improvers, anti-foaming agents, anticorrosion agents, detergents etc.

The liquid fuel compositions of the gas oil type according to the invention can be prepared by mixing the liquid fuel, additive composition(s) according to the invention and other optional additive(s), in one or more steps, generally at ambient temperature. The scope of the invention would not be exceeded by separately mixing the components of the additive composition according to the invention (additives a) to c)), optionally additives d) to i), the solvent(s) and/or co-solvent(s)), the other optional additives (in the form of a package or not) with the fuel of the gas oil type.

According to a fourth subject, the invention relates to the use of the additive compositions as described above as an agent for improving storage stability, oxidation resistance, low-temperature performance and, more particularly, engine performances in particular reduction in fouling (fouling and clogging) by gas oil fuels, in particular, by non-road gas oil fuels.

The invention also relates to the use of the gas oil-based liquid fuel compositions according to the invention as defined above as higher-grade fuels of the gas oil type, i.e. having storage stability properties and, towards materials, oxidation resistance, low-temperature performance and, more particularly, engine performances in particular a reduction in fouling (fouling and clogging) greater than that of a standard grade on-road and non-road gas oil (which, as a minimum, meets the specifications of the standard EN 590).

The higher grade gas oil according to the invention, i.e. comprising at least one additive composition according to the invention, can be advantageously used as fuel for the engines of the non-road machinery listed in the Decree of 10/12/10, namely

- non-road mobile machinery, such as
- construction equipment, in particular bulldozers, all-terrain trucks, excavators, tractors and loaders,
- road maintenance equipment
- snow ploughs and street sweepers,
- self-propelled agricultural vehicles, forestry equipment,
- handling equipment, mobile cranes, power lift trucks,
- self-propelled ladders and platforms,
- ground airport assistance equipment
- industrial drilling equipment,
- compressors and motor-driven pumps,
- railway locomotives,
- truck-mounted generators or hydraulic power units,
- agricultural or forestry tractors,
- pleasure boats,
- inland navigation boats.

EXAMPLES

The characteristics of non-road gas oils in compliance with the decree of 10 Dec. 2010, i.e. of standard grade non-road gas oils, are listed in Tables 1 and 2 below.

TABLE 1

Characteristics of non-road gas oil (decree of 10 Dec. 2010)

| PROPERTIES | UNIT | LIMITS Mini | LIMITS Maxi |
|---|---|---|---|
| Measured cetane index | | 51.0 | |
| Calculated cetane index | | 45.0 | |
| Density (at 15° C.) | $kg/m^2$ | 820 | 845 |
| Polycyclic aromatic hydrocarbons | % (m/m) | — | 8.0 |
| Flash point | ° C. | >55 | — |
| Carbon residue (out of 10% distillation residue) | %(m/m) | — | 0.30 |
| Ash content | %(m/m) | — | 0.01 |
| Water content | mg/kg | — | 200 |
| Total contamination | mg/kg | — | 24 |
| Copper strip corrosion (3 h at 50° C.) | Rating | Class 1 | |
| Oxidation stability 1: | $g/m^2$ | — | 25 |
| | h | 20 | — |
| Oxidation stability 2: | mg | — | 0.30 |
| Acid number variation | KOH/g | | |

TABLE 1-continued

Characteristics of non-road gas oil (decree of 10 Dec. 2010)

| PROPERTIES | UNIT | LIMITS Mini | LIMITS Maxi |
|---|---|---|---|
| Lubricity: corrected wear scar diameter (wsd 1.4) at 60° C. | μm | — | 460 |
| Viscosity at 40% | $mm^2/s$ | 2.00 | 4.50 |
| Distillation: | | | |
| % (v/v) condensed at 250° C.: | % (v/v) | | 65 |
| % (v/v) condensed at 350° C.: | % (v/v) | 85 | — |
| point at which 95% (V/V) condensed: | ° C. | — | 360 |
| Fatty acid ester content in compliance with the decree of ** ** 2010 relating to the characteristics of the fatty acid methyl esters | % (V/V) | — | 7.0 |

TABLE 2

Characteristics of the non-road gas oil (decree of 10 Dec. 2010) (continued)

| SEASON | DATE | CLASS | CFPP(° C. max) |
|---|---|---|---|
| Summer | 1st April-31 October | B | 0° C. |
| Winter | 1st November-31 March | E | −15° C. |
| Extreme cold non-road gas oil | | F | −20° C. |

CFPP: cold filter plugging point

Example 1

Preparation of Additive Compositions F1 to F5

Several additive compositions are prepared by mixing at ambient temperature several of the components listed below in proportions shown in Table 3

- N,N'-disalicylidene 1,2-diaminopropane (metal-sequestering agent a)
- BHT (alkylphenol type antioxidant) b)
- PIBSI (dispersant c))
- dicyclohexylamine (neutralizer d)
- aromatic solvent (mixture of Solvarex 10 and 10 LN)
- 50/50 by weight mixture of EVA copolymer and VEOVA terpolymer in solution in aromatic solvent (CFPP additive e))
- benzotriazole (metal passivator i))

TABLE 3

Components (% by mass)

| | a) sequestering agent | b) antioxidant | d) neutralizer | c) dispersant | i) passivator | e) CFPP | Solvent |
|---|---|---|---|---|---|---|---|
| F1 | 1 | 5 | 0 | 0 | 0 | 14 | 80 |
| F2 | 0 | 10 | 0 | 0 | 1 | 14 | 75 |
| F3 | 1.5 | 4.5 | 0.75 | 1.5 | 1.5 | 14 | 76.25 |
| F4 | 1 | 2.25 | 1.5 | 1.5 | 0 | 14 | 79.75 |
| F5 | 1 | 3 | 0.5 | 1 | 1 | 14 | 79.5 |

The viscosity of the additive compositions F3 and F5 at 20, 40 and −10° C. is measured according to the standard NF EN ISO 3104, as well as their storage stability over time according to the method described in detail below:

each pure additive composition is placed in a transparent glass conical flask which is left closed at a chosen constant temperature; the tested composition is considered to be stable and homogeneous at the chosen temperature if, after 10 days at said temperature, either it has not a demixed liquid phase the proportion of which would be greater than 0.5% of its volume, or it has not sediment or solid deposit greater than 0.05% of its volume. Stability tests were carried out at two different temperatures:

at laboratory temperature (approximately 20° C.) which corresponds to standard test conditions at −10° C., taking account of the presence of certain components capable of crystallizing and forming deposits at this temperature.

The results are shown in Table 4 below.

TABLE 4

| Characterization | unit | Additives F5 | Additives F3 |
|---|---|---|---|
| Viscosity at 20° C. | $mm^2/s$ | 7.486 | 8.451 |
| Viscosity at 40° C. | $mm^2/s$ | 4.744 | 5.322 |
| Viscosity at −10° C. | $mm^2/s$ | 30.28 | 33.96 |
| Conical flask stability Ambient temperature (20° C.) for 10 days | — | 0.05% by vol. whitish demixed medium | t = 10 days black deposit <0.05% v |
| conical flask stability −10° C. for 10 days | — | no demixing nor deposit | no demixing nor deposit |
| Density @15° C. | $kg/m^3$ | 899.9 | 896.2 |

Example 2

Evaluation of the Effect of the Compositions F1 to F5 on the Diesel Injector Fouling (Direct Injection) According to the XUD9 Procedure Injector fouling tests according to the XUD9 procedure were carried out on 5 compositions of non-road gas oil B7 comprising respectively the compositions F1 to F5 of Example 1, as well as on the same pure non-road gas oil B7 evaluated at the start and at the end of the series so as provide a context for the results and verify the stability of the engine.

The fouling test implemented has the following characteristics:

The objective of this test is to evaluate the performance of the fuels and/or of additive compositions towards the fouling of the injectors on a four-cylinder Peugeot XUD9 A/L engine with indirect diesel injection.

The test was started with a four-cylinder Peugeot XUD9 NL engine with indirect diesel injection equipped with clean injectors the flow rate of which was determined beforehand. The engine follows a defined test cycle for 10 hours and 3 minutes (repetition of the same cycle 134 times). At the end of the test, the flow rate of the injectors is again evaluated. The quantity of fuel required for the test is 45 L. The loss of flow rate is measured on the four injectors. The results are expressed as a percentage of loss of flow rate for different needle lifts. Usually the fouling values at 0.1 mm of needle lift are compared as they are more discriminatory and more accurate and repeatable (repeatability <5%).

TABLE 5

Results of XUD9 engine tests procedure: GOM B7 with 1000 ppm vol./vol. of composition Fi

| Fouling test | Compositions | Level of injector fouling * (%) (* average of the 4 injectors) | Gain/average of tests 0 and 6 (%) |
|---|---|---|---|
| Test 0 | GOM B7 EN590 | 72 | 0.8 |
| Test 1 | GOM B7 + F1 | 65.8 | 5.4 |
| Test 2 | GOM B7 + F2 | 70.5 | 0.7 |
| Test 3 | GOM B7 + F3 | 60.7 | 10.5 |
| Test 4 | GOM B7 + F4 | 60.9 | 10.3 |
| Test 5 | GOM B7 + F5 | 61.2 | 10 |
| Test 6 | GOM B7 EN590 | 70.4 | 0.8 |
| Average of Tests 0 + 6 | GOM B7 EN590 | 71.2 | |

The non-road gas oil containing 7% (vol/vol) or (v/v) of FAME and corresponding to the standard EN590 for tested pure gas oil shows a level of fouling of the order of 70% (72% at the start and 70.4% at the end of the series). All the tested compositions containing additives show a level of fouling ranging from 60.7 to 70.5%, therefore equivalent to or less than that of the pure non-road gas oil B7 tested. The best cases measured show a gain greater than or equal to 10%.

It is noted that the compositions F1, F3, F4 and F5 are more effective in limiting the fouling of the XUD9 injectors.

Example 3

Evaluation of the Oxidation Stability

The oxidation stability of compositions of non-road gas oil B7 (GOM B7) comprising one of the additive compositions F1 to F5 was measured according to the Rancimat method (standard EN15751) and, by way of comparison, that of the non-road gas oil without additives was also measured. The results are shown in Table 6.

TABLE 6

Oxidation stability according to EN 15751: GOM B7 with 1000 ppm vol./vol. of composition Fi added

| Stability tests | Formulations | Induction period (h) | Gain/pure GOM B7 (h) |
|---|---|---|---|
| Test 0 | GOM B7 EN590 | 18 | |
| Test 1 | GOM B7 + F1 | 33 | 15 |
| Test 2 | GOM B7 + F2 | >48 | >30 |
| Test 3 | GOM B7 + F3 | 40 | 22 |
| Test 4 | GOM B7 + F4 | 28 | 10 |
| Test 5 | GOM B7 + F5 | 28 | 10 |

It is noted that the presence of additives in non-road gas oil makes it possible to improve the induction period (gain from 10 to >38 hours compared with the fuel without additives). The oxidation stability of compositions of non-road gas oil B7 comprising one of the additive compositions Fi was measured according to the method described in detail in the standard ISO 12205 (gum content) and according to the method described in detail in the standard ISO 6618 (acid number variation). The results relating to gum formation are shown in Table 7 and those relating to the acid number are shown in Table 8.

TABLE 7

Oxidation stability according to EN 12205 at 115° C.: GOM B7 with 1000 ppm vol./vol. of composition Fi added

| Stability tests | Compositions | Gum content ($g/m^3$) | Gain/pure GOM B7 ($g/m^3$) |
|---|---|---|---|
| Test 0 | GOM B7 EN590 | 29 | |
| Test 1 | GOM B7 + F1 | 24 | 5 |
| Test 2 | GOM B7 + F2 | 21 | 8 |
| Test 3 | GOM B7 + F3 | 11 | 18 |
| Test 5 | GOM B7 + F5 | 14 | 15 |

TABLE 8

Acid number variation ISO 6618 (mg KOH/g): GOM B7 with 1000 ppm vol./vol. of composition Fi added

| Stability tests | Compositions | Delta TAN (mg KOH/g) |
|---|---|---|
| Test 0 | GOM B7 EN590 | 4.73 |
| Test 1 | GOM B7 + F1 | 0.02 |
| Test 2 | GOM B7 + F2 | 0.95 |
| Test 3 | GOM B7 + F3 | 0.4 |
| Test 4 | GOM B7 + F4 | 0.81 |
| Test 5 | GOM B7 + F5 | 0.71 |

It is noted that non-road gas oils comprising the compositions F1 to F5 have limited gum content variation and acid number variation compared with gas oil without additives. The formulations F3 and F5 are the most effective in limiting gum formation (Table 7). As regards the acid number variation, it is noted that the compositions F1 and F3 are the most effective for limiting the development of acidity (Table 8).

Example 4

Evaluation of the Resistance to Contact with Metals

The effectiveness of the resistance to contact with metals of the non-road gas oil compositions with or without an additive composition Fi added was measured according to the method described in detail below:

a metal plate of zinc or copper is brought into contact with 100 mL of the fuel in a 125 mL glass flask; the metal strip is completely immersed for 7 days at ambient temperature (approximately 20° C.). The metal surface area in contact with the fuel is 10 $cm^2$. After this period of contact, the copper or zinc metals which are present in the fuel are assayed. The results are shown in Table 9 below.

TABLE 9

Soaking test 7 days at 20° C.: GOM B7 with 1000 ppm vol./vol. of composition Fi added

| Metal extraction tests | Compositions | Cu content (mg/kg) | Zn content (mg/kg) |
|---|---|---|---|
| Test 0 | GOM B7 EN590 | 3 | 6.7 |
| Test 1 | GOM B7 + F1 | 2.95 | 3.1 |
| Test 2 | GOM B7 + F2 | <0.1 | <0.1 |
| Test 3 | GOM B7 + F3 | <0.1 | <0.2 |
| Test 4 | GOM B7 + F4 | 5.7 | 10.2 |
| Test 5 | GOM B7 + F5 | <0.1 | 0.1 |

GOM B7 tested: GOM EN 590 having been used for soaking a strip of Cu and a strip of Zn for 7 days at 20° C. It is noted that the compositions F2; F3 and F5 are the most effective in limiting the dissolution of the copper and of the zinc.

Example 5

Oxidation stability tests according to the Rancimat method (standard EN15751) are carried out on the fuel compositions brought into contact beforehand with metals such as zinc or copper as described in Example 4. The results obtained according to the Rancimat method show a degradation of the stability of the GOM B7 compared with stability tests on fuels which have not been brought into contact with the metals of Example 3. The results are shown in Table 10 below.

TABLE 10

GOM B7 with 6.7 ppm of Zn with 1000 ppm vol./vol. of composition F2 and F3 added

| Stability tests | Formulations | Induction period (h) | Gain/pure GOM B7 (h) |
|---|---|---|---|
| Test 0 | GOM B7 EN590 | 8 | |
| Test 2 | GOM B7 + F2 | 12 | 4 |
| Test 3 | GOM B7 + F3 | 41 | 33 |

It is noted that the fuel with F3 added is the most effective (highest induction period).

Example 6

The cold filter plugging point according to the standard NF EN 116 of several EN 590 non-road gas oils of type B0 (without FAME) or B7 (with 7% vol./vol. of FAME), with or without 1000 ppm v/v of the composition F3 added, was measured. The CFPP gain was also measured with respect to the same gas oil without additives. The results are shown in Table 11.

TABLE 11

Evaluation of the low-temperature performance CFPP NF EN 116 - GOM B7 with 1000 ppm vol./vol. of composition F3 added

| GOM | Initial CFPP (° C.) | CFPP GOM with additives (° C.) | CFPP gain/pure GOM (° C.) |
|---|---|---|---|
| GOM B0 A | −1 | −14 | 13 |
| GOM B7 B | −2 | −13 | 11 |
| GOM B7 C | −18 | −22 | 4 |
| GOM B7 D | −15 | −21 | 6 |
| GOM B0 E | −16 | −28 | 12 |
| GOM B7 F | −14 | −29 | 15 |

It is noted that according to the gas oils tested, the composition F3 makes it possible to improve the CFPP with a gain of 4 at 15° C. with an additive content of 1000 ppm vol./vol.

Example 7

Evaluation of the Effect of the Composition F3 on Diesel Injector Fouling (Direct Injection) According to the CEC DW10 Procedure SG-F-098

Injector fouling tests according to the CEC DW10 procedure referenced SG-F-098 were carried out on a gas oil composition B7 corresponding, as a minimum, to the specification EN 590 comprising the composition F3 of Example 1, denoted $G_1$, as well as on the same composition of pure gas oil B7, denoted $G_0$, evaluated at the start and at the end of the series so as to provide a context for the results and verify the stability of the engine. The test uses a DW10BTED4 engine developed by PSA Peugeot Citroën, having a cylinder capacity of 1998 $cm^3$, with direct diesel injection, in compliance with the Euro 4 emission standards if the vehicle is equipped with a particulate trap. Table 12 summarizes the main characteristics of the engine:

TABLE 12

| | |
|---|---|
| Configuration | 4 in-line cylinders, overhead camshaft, equipped with a turbocharger and exhaust gas recirculation (EGR) |
| Performances | 100 kW @ 4000 rpm<br>320 NM @ 2000 rpm |
| Injection system | Common rail with 6-hole piezo electric injectors, developed by Continental Automotive, Maximum injection pressure: 1660 bar |

The fouling test implemented has the following characteristics: The fouling procedure lasts 32 hours. The 32 hours are divided into four 8-hour periods interspersed with periods of maceration, each lasting 4 hours, during which the engine is stopped. In order to accelerate the fouling of the injectors, 1 ppm of zinc by mass in the form of zinc neodecanoate of formula $Zn(C_{10}H_{19}O_2)_2$ is added to the fuel.

The test evaluates the loss of power of the engine after running for 32 hours. A slight loss of power reflects slight fouling. The additive composition is therefore judged by its non-fouling nature and its ability to prevent deposits when it is introduced into the fuel in the presence of zinc.

At each cycle, the value of the power on the twelfth stroke (4000 rpm fully loaded) is measured. The test result is the loss of power measured at this point between the end of the test (linear average of the last 5 measurements) and the start of the test (linear average of the first 5 measurements). FIG. 1 shows the fouling obtained for the reference fuel $G_0$+1 ppm Zn and for the fuel according to the invention $G_1$+1 ppm Zn. Based on these measurements, a power loss value for $G_0$+1 ppm Zn of the order of −5.6% was determined whereas no loss of power was observed for G1+1 ppm Zn.

Consequently, these results show that the gas oil composition $G_1$ according to the invention has a non-fouling nature. Moreover, the additive composition F3 is remarkable in that it has a high capability for preventing deposits when it is introduced into a gas oil fuel in the presence of zinc.

The invention claimed is:

1. Additive liquid compositions for a liquid fuel composition of a gas oil type, comprising:

a. from 0.1 to 5% by mass of at least one metal deactivator or chelating agent chosen from amines substituted by N,N'-disalicylidene groups;

b. from 1 to 30% by mass of at least one antioxidant of a hindered phenol type (alkylphenol);

c. from 0.5 to 10% by mass of at least one dispersant and/or detergent; and d. from 0.1 to 5% by mass of at least one metal passivator chosen from N,N-bis(2-ethylhexyl)-1,2,4-triazol-1-ylmethanamine, and N,N'-bis-(2 ethylhexyl)-4-methyl-1H-benzotriazole amine, alone or in a mixture.

2. The additive compositions according to claim 1, comprising at least one hydrocarbon organic solvent and/or at least one compatibilizing agent or co-solvent.

3. The additive compositions according to claim 1, wherein the dispersants and/or detergents are chosen from the substituted amines, the polyetheramines, the products of reaction between a phenol substituted by a hydrocarbon chain, an aldehyde, and an amine or polyamine or ammonia, carboxylic dispersants, aminated dispersants originating from the reaction between halogenated aliphatics of high molecular weight with amines or polyamines, polymeric dispersants obtained by polymerization of C8-C30 alkylacrylates or C8-C30 alkylmethacrylates, aminoalkylacrylates or acrylamides and acrylates substituted by poly-(oxyethylene) groups.

4. The additive compositions according to claim 1, comprising:

at least one acid scavenger of the amine type.

5. The additive compositions according to claim 1, further comprising from 0.5 to 20% by mass of at least one acid scavenger.

6. A method for the preparation of an additive composition for a liquid fuel composition of a gas oil type, the method comprising mixing components of: at least one metal deactivator or chelating agent chosen from amines substituted by N,N'-disalycylidene groups to a concentration of from 0.1 to 5% by mass; at least one antioxidant amount of a hindered phenol type to a concentration of from 1 to 30% by mass; at least one dispersant and/or detergent to a concentration of from 0.5 to 10% by mass; and at least one metal passivator chosen from N,N-bis(2-ethylhexyl)-1,2,4-triazol-1-ylmethanamine, and N,N'-bis-(2 ethylhexyl)-4-methyl-1H-benzotriazole amine, alone or in a mixture to a concentration of from 0.1 to 5% by mass; in one or more steps.

7. The additive compositions according to claim 1, further comprising one or more components selected from:

at least one acid scavenger of the aliphatic, cycloaliphatic or aromatic amine type;

at least one low-temperature performance additive;

at least one tracer or marker;

at least one fragrancing agent and/or agent for masking odours and/or reodorant; and at least one biocide.

8. The additive compositions according to claim 7, wherein:

the acid scavengers are chosen from the aliphatic, cycloaliphatic and aromatic amines; and the low-temperature performance additives are chosen from the additives improving the pour point, the additives improving the cold filter plugging point (CFPP), additives improving the cloud point and/or the anti-sedimentation and/or paraffin dispersant additives.

9. The additive compositions according to claim 7, further comprising one or more components selected from:

at least one additive for improving low-temperature performance chosen from the EVA copolymers and/or VEOVA terpolymers; and at least one fragrancing agent and/or agent for masking odours and/or reodorant, chosen from:

the organic tricyclic compounds of formula (I) below (I)

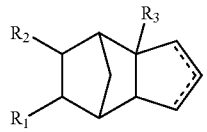

in which the cyclopentane ring is saturated or unsaturated, and R1, R2, R3, identical or different, are chosen from hydrogen, the hydrocarbon radicals comprising from 1 to 10 carbon atoms and the hydrocarbon radicals comprising from 1 to 10 carbon atoms and one or more heteroatoms, essential oils, and mixtures thereof.

10. The additive compositions according to claim 7, comprising:

from 0 to 20% by mass of the acid scavengers;

from 0 to 30% by mass of the low-temperature performance additive(s);

from 0 to 5% by mass of tracer(s);

from 0 to 10% by mass of the fragrancing agent(s) and/or agent(s) for masking odours and/or reodorant(s); and from 0 to 20% by mass of the biocide(s).

11. The additive compositions according to claim 1, wherein the antioxidant of a hindered phenol type (alkylphenol) is selected from di-t-butyl-2,6 methyl-4 phenol (BHT), t-butyl hydroquinone (TBHQ), 2,6 and 2,4 di-t-butyl phenol, 2,4-dimethyl-6-t-butyl phenol, pyrogallol, tocopherol, 4,4'-methylene bis (2,6-di-t-butyl phenol) (CAS No. 118-82-1), alone or in a mixture.

12. The method according to claim 6, further comprising storing the additive composition at a temperature of from −15° C. to 40 ° C.

* * * * *